United States Patent [19]

Caprette, Jr.

[11] Patent Number: 4,821,243

[45] Date of Patent: Apr. 11, 1989

[54] LOW PRESSURE ACOUSTIC REFLECTOR FOR CONFORMAL ARRAYS

[75] Inventor: Samuel J. Caprette, Jr., Chagrin Falls, Ohio

[73] Assignee: The B.F. Goodrich Company, Akron, Ohio

[21] Appl. No.: 44,917

[22] Filed: May 1, 1987

[51] Int. Cl.[4] ..... H04R 17/00

[52] U.S. Cl. ..... 367/153; 367/151; 181/198

[58] Field of Search ..... 367/137, 1, 151, 153, 367/154, 162, 165, 169, 173, 176, 901; 181/175, 198; 114/242, 243, 253

[56] References Cited

U.S. PATENT DOCUMENTS

| | | | |
|---|---|---|---|
| 2,884,084 | 4/1959 | Sussman | 181/290 |
| 3,130,700 | 4/1964 | Peterson | 367/1 |
| 3,412,513 | 11/1968 | Gösele | 181/290 |
| 3,647,022 | 3/1972 | Meyer et al. | 367/153 |
| 3,923,118 | 12/1975 | Johansen | 181/180 |
| 4,090,171 | 5/1978 | Bulmer et al. | 367/153 |
| 4,164,727 | 8/1979 | Morris | 367/153 |
| 4,390,976 | 6/1983 | Eynck | 367/153 |
| 4,399,526 | 8/1983 | Eynck | 367/153 |
| 4,450,544 | 5/1984 | Denaro et al. | 367/153 |

*Primary Examiner*—Thomas H. Tarcza
*Assistant Examiner*—Tod R. Swann
*Attorney, Agent, or Firm*—W. W. Ban; D. M. Ronyak

[57] ABSTRACT

A baffle for use in baffling or reflecting acoustic frequencies in a marine environment wherein a core ply of fiber or fabric reinforced rubber sheet is sandwiched between a pair of plies formed of an elastomeric substance and having fluid filled pockets embeddedly positioned therein in a regular, spaced relationship. The reflector functions to baffle or reflect undesired acoustic frequencies typically in conjunction with the operation of sonar arrays.

20 Claims, 2 Drawing Sheets

LOW PRESSURE ACOUSTIC REFLECTOR FOR CONFORMAL ARRAYS

FIELD OF THE INVENTION

This invention concerns devices for the transmission and/or reception of so-called sonar or asdic acoustic signals in a marine environment. More specifically, this invention concerns acoustic baffles or so-called reflectors useful in preventing the transmission of noise from one area of a marine environment to another area of a marine environment and thereby shielding sensitive acoustic arrays configured for the transmission or reception of acoustic waveforms from spurious or undesired waveforms. Particularly, this invention relates to structures and configurations for such baffles or reflectors and to the adaptation of such baffles or reflectors for use in a low hydrostatic pressure marine environment.

BACKGROUND OF THE INVENTION

The use of acoustic waveforms in the detection and the identification of objects and their position below a surface level of a marine environment has been known since at least the 1940s. Two basic systems (active and passive) employing acoustic waves forms are common to the vast majority of sonar or asdic applications in marine environments. In the so-called active system acoustic waveforms are transmitted through the marine environment. Upon contacting an object these acoustic waveforms are in part reflected back in a direction generally towards the source of the transmission and may be received by the use of appropriate acoustic waveform receiving apparatus at or adjacent the point of transmission of the acoustic waveform. These active systems are characterized, for example, by active sonar systems employed for the detection of submarines and the like, and also by such devices as echo depth finders and fish finders.

As an alternate, so-called passive systems have been developed which function to receive acoustic waveforms generated elsewhere and transmitted through the marine environment. Such passive systems, typified by a passive sonar apparatus, generally receive acoustic waveform signals generated by, for instance, noise internal to a submarine operating below the surface of a marine environment. Alternately, such passive systems may receive acoustic waveforms generated by an active but remote source and reflected off an object within the marine environment. Passive systems find great utility in detecting the stealthy pressure or movement of underwater objects such as submarines and other noise generating underwater objects.

Arrays of acoustic receptors/transmitters configured for operation in such systems can typically be required to transmit and/or receive acoustic energy having a frequency range of about 500 hz to about 2500 khz. These frequencies correspond to wave lengths of about 3 meters to about 0.0006 meters in seawater, with the wave lengths being subject to some variation depending upon the density of water or any other material through which the waveform is being propagated. For example the wavelengths will become altered upon passing from seawater characterizing the marine environment into a material of construction constituting a window in, for example, a sonar device.

Reflectors, or baffles are imposed for reducing, and ideally for preventing the transmission of noise from one area to another. Ideally, a very efficient way of preventing such transmission is by interposing a compliant layer between the noise source and the area to be protected. An ideal baffle, for example, might be simply a layer of air. Air, however, tends not to remain where placed in a marine environment unless contained. The continuous injection or introduction of air to form a screening film of bubbles or the like into a marine environment can be noisy and where silence or near silence is desired this noise can offset any gains or desired effects available by reason of the screening air being present in the marine environment.

Structural baffles or reflectors wherein contained air provides a baffling or reflecting feature are known and have been employed, for example, by the U.S. Navy under the designations AD-XY where X and Y are typically numbers. Structures for baffles and reflectors traditionally have been a design compromise between obtaining adequate compliance to assure necessary acoustic performance in baffling and necessary structural performance in meeting the mechanical requirements imposed by the operating environment. These mechanical requirements can be particularly demanding in high pressure baffles, that is, those configured to withstand elevated hydrostatic pressures without loss of substantial baffling properties, such as might be employed in or on deep diving submarines and the like.

A low pressure baffle conversely is one configured principally for operation on objects such as surface ships and not exposed typically to the intense hydrostatic pressures associated with deep diving. These low pressure baffles have often been modeled upon traditionally the structurally more rigid high pressure baffles and consequently have been relatively expensive, less than optimal in baffling performance or relatively nonuniform in baffling performance.

A low pressure baffle of a simple, inexpensive design, could find substantial utility in commerce. Particularly where a baffle or reflector is shielded or not directly exposed to hydrodynamic forces associated with the movement of water over an object embodying such a baffle or reflector, and the baffle made therefor substantially more compliant as a result of reduced mechanical demands imposed by the operating environment, such utility could be markedly enhanced.

SUMMARY OF THE INVENTION

The present invention provides an acoustic reflector or baffle. The reflector includes a core ply. The core ply is formed of an elastomer reinforced employing a fabric, or so-called coated fabrics. The core ply is formed into a sheet having a pair of surfaces.

A pair of pocket plies are provided. The pocket plies are bonded one to each of the pair of core ply surfaces.

A plurality of attachment points are provided. A means is provided for attaching the core ply to the attachment points whereby the core ply is tensioned.

Each of the pocket plies includes a plurality of cell-like cavities embeddedly positioned within the pocket ply. The cell-like cavities are of a size and configuration defined by walls separating adjacent cells or cavities within the pocket plies, and, at least with respect to the surface of the ocket ply not bonded laminated to a surface of the core ply, by a layer forming a diaphragm-like "roof" over each cell or cavity. The pocket ply is formed of an elastomeric material such as an elastomer having desired dynamic properties with respect to the particular acoustic frequency it is desired be baffled at the particular temperature it is desired the reflector function.

In preferred embodiments, a surface of one of the pocket plies which is not bonded to the core ply is affixed to a support surface. This support surface typically is a hull of or a fairing of marine surface vessel.

The cell-like cavities can be of any suitable or conventional configuration, but typically take the form of frustums, and where polyhedral, are regularly configured. These cavities are uniformly spaced throughout the pocket ply thereby tending to provide a consistent and uniform level of performance for the reflector or baffle.

In use, the baffles or reflectors typically are employed within a fairing embodied upon a marine object and in combination with an acoustic array. The fairing together with surfaces of the marine object with which the fairing is associated function to define a chamber. The chamber typically includes an acoustic window which functions together with the fairing and the surfaces of the marine object to define a closed chamber shielded from hydrodynamic forces associated with motion of the marine object through the marine environment, or motion of the marine environment relative to the marine object, should the marine object be fixed. The acoustic array may be configured for transmission or reception of acoustic frequencies passing through the window; the baffle or reflector functions to shield the acoustic array from undesirable acoustic noise or frequencies which may be inherent within the chamber, emanate from the object to which the baffle is attached, result from activities associated with operation of the acoustic array or result from motion of the marine object or of the marine environment.

The above and other features and advantages of the invention will become more apparent when considered in light of a description of a preferred embodiment of the invention and a drawing in the form of three figures which follow, together forming a part of the specification.

BEST EMBODIMENT OF THE INVENTION

Figure 1:
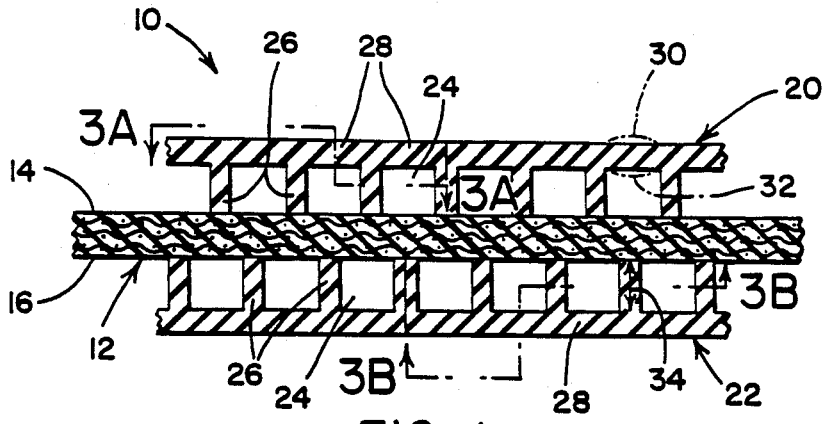
FIG. 1 is a partial cross-sectional depiction of a baffle or attenuating reflector made in accordance with the invention.

Referring to the drawings, FIG. 1 is a depiction of a attenuator 10 made in accordance with the invention. The attenuator 10 includes a core ply 12 having a pair of surfaces 14, 16 and a pair of pocket plies 20, 22. The core ply is formed from fabric reinforced elastomer or so-called coated fabric. By fabric what is meant is knit, woven, cord, wire, cable or chopped fiber reinforcement formed from suitable or conventional either natural or synthetic fibrils such as steel, polyester polyaramide, polyimide and the like acceptable for use in a marine environment which may, Optionally have been spun and/or otherwise formed into bundles of fibrils for purposes of providing reinforcing cords, mesh, knit, or other fabric materials. If chopped, the chopped fiber can either be chopped mono-filaments or fibrils or may be a chopped fiber derived from chopping spun or otherwise bundled fibrils.

The elastomers used in forming the core ply 12 can be of any suitable or conventional nature and may include natural rubber, synthetic rubbers, such as a chlorinated rubber, NEOPRENE ®, for example, (duPont) silicone rubbers, and similar rubbers, or may be polybutadiene, acrylonitrile-butadiene copolymer, or styrene-butadiene rubbers. The particular selection of coated fabric and elastomer employed in fabricating the core ply will be a function of any tension under which the core ply is maintained, the temperature and acoustic conditions under which the core ply is to be employed, and the degree of elasticity it is desired the core ply demonstrate upon exposure to hydrostatic or other forces applied thereto. The fabrication of coated fabrics such as fabric reinforced rubberized sheeting is well-known, and conventional well-known techniques may be employed for fabricating the core ply 12.

The pocket plies 20, 22 are likewise formed from an elastomeric material. In addition to natural rubbers: synthetic polymers such as polyurethanes; synthetic rubbers, such as styrene-butadiene; acrylonitrile based rubbers more commonly known in industry as nitrile rubbers; chlorinated rubbers; polybutadienes; ethylene-propylene based co-polymers; acrylic-butadiene copolymers; silicone rubbers; and combinations thereof can be employed in the making of the pocket plies 20, 22.

The rubbers and elastomers employed in the practice of the invention in forming the pocket plies 20, 22 may include a filling agent. This filling agent, which may be present in a quantity of between 0 and about 50 parts per hundred weight of the rubber or elastomer and, generally is present in a quantity of between 0 and 40 parts per hundred weight of the rubber or elastomer may be a particulate such as carbon black, glass micro spheres or micro beads or may be a fiber-like additive such as mineral, polyester, polyolefin, polyaramide, polyamides, polyimides, or polyvinyls such as polyvinyl alcohol (e.g. 1 mm.6 denier). The extent to which fillers are employed in fabricating the pocket plies 20, 22 will be at least in part a function of the dynamic acoustical properties such as longitudinal propagation and attenuation or loss tangent characteristics desired for acoustic waveforms impacting the pocket plies 20, 22 and by any dynamic modulus, static modulus and Young's modulus properties it is desired be achieved in any resulting pocket ply as well as by the static shear properties it is desired be displayed.

What is meant by "elastomeric" or "elastomer" is a material possessed of an ability to recover at least in part a former figure or shape up on removal of a figure or shape distorting force.

By "rubber" as used herein what is meant is a vulcanized, or cross-linked elastomer made according to conventional well-known techniques.

It should be understood that other suitable materials may be employed for forming the pocket plies 20, 22 providing the constraints regarding, for example, static shear modulus, Young's modulus, density, loss tangent, dynamic acoustical properties, column spring properties, static tensile modulus and dynamic modulus are satisfied for the use of the material. It is preferred that pocket plies be possessed of: a static tensile or Young's modulus of between about 200 psi (1379 kPa) to about 1200 psi (8274 kPa); a density, excluding the volume of any cells cavities therein, of between about 0.95 and about 1.60 gm/cc$^3$; loss tangent properties of between about 0.05 and about 0.40; dynamic shear modulus (dynes/cm$^2$) properties of $\leqq 1\times 10^9$ for the diaphragms or roofs and certain wall zones, and $\leqq 5\times 10^8$ for certain cell or cavity wall zones it is desired be possessed of spring properties; static shear modulus properties of between about 65 psi (448 kPa), and about 400 psi (2758 kPa); loss tangent properties of between about 0.05 and about 0.40; and a void volume represented by any cells or cavities of between about 30% and about 80%.

By the term Young's modulus as used herein what is meant is a ratio of a simple tensile stress applied to a material to the resulting strain parallel to the tension. The Young's modulus is also a measure of the modulus of the elasticity for the material which modulus of elasticity may also be known as coefficient of elasticity, the elasticity modulus, or the elastic modulus. By the term tensile modulus what is meant is the tangent or secant modulus of elasticity of a material in tension. By density what is meant is weight per unit volume. By loss tangent what is meant is a ratio of the viscous modulus to the elastic modulus for the particular material. By viscous modulus what is meant is that modulus proportional to a deforming force not recovered or conserved. The viscous modulus typically is observed only under dynamic stress. By elastic modulus what is meant is the ratio of an increment of some specified form of stress to the increment of some specified form of strain which may also be known as the coefficient of the elasticity and in certain instances can be representated by the Young's modulus. The elastic and the viscous modulus are hereinafter referred to as dynamic moduli.

The pocket plies 20, 22 are generally possessed of a loss tangent or so-called loss factor of at least 0.05 and less than about 0.40 over the frequency range of acoustical signals being impinged upon the baffle or reflector. A greater or lesser loss tangent may be necessary, however, depending upon the particular application for the baffle or reflector.

The pocket plies 20, 22 are bonded one to each surface of the core ply 12. Bonding is typically accomplished employing a vulcanizable adhesive such as numbers, 205, 233, 234, 250, or 252 obtainable from CHEMLOC, AS1 available from The B. F. Goodrich Company, or NEOPRENE based adhesives such as HYDROLOCK 100 available from The B.F. Goodrich Company. The use of vulcanizable adhesives to bond rubber sheets such as the core ply 12 to rubber structures such as the pocket ply 20, 22 are well-known.

The pocket plies 20, 22 include a plurality of cavities 24. The cavities 24 are cell-like cavities, that is walls 26 function to separate the cells 24 one from the next. A portion of the pocket ply 28 may form or define a diaphragm-like roof for each cell 24 thereby closing the cell in cooperation with the core ply 12.

Figure 3A:
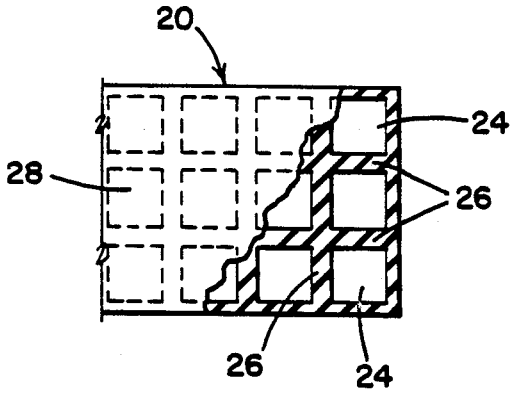
FIG. 3 is a depiction in partial cut-away of a surface view of a baffle or attenuating reflector made in accordance with the invention.
Figure 3B:
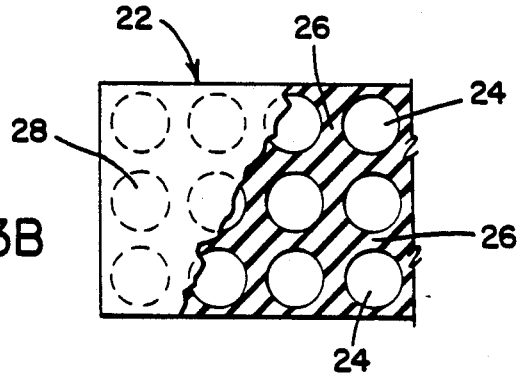

It is important to assuring consistency of acoustic performance for the baffles or attenuators 10 that the cavities 24 be generally uniform in size and physical configuration. Typically the cells 24 are frustums, that is of the form of truncated geometric solids in configuration. Referring to FIGS. 3A, 3B it may be seen that the cells 24 can be conical or rectilinear truncated solids in configuration. The cavities 24 may be evacuated, may be filled with a gas under pressure greater than, equal to, or less than atmospheric pressure, or may be filled with other compressible (compliant) fluids or combination of fluids. By fluids what is meant is suitable or conventional gases, liquids or combinations thereof.

The cells must not fill or be filled with a substantially incompressible fluid such as sea water and any filling fluid must be substantially more compressible than the fluid of the surrounding marine environment, preferably an order of magnitute more compliant.

The diaphragm 28 for each cell 24 can be deformed between positions 30, 32 as shown in FIG. 1. This deformation permits an enhanced baffling effect of acoustic frequencies. Where the fluid filling the cells 24 is not substantially more compressible than the fluid of the surrounding marine environment, deflection at least to the position 32 is made quite difficult.

The walls 26 may be capable of spring-like accommodation of energy as shown by a double-headed arrow 34 in FIG. 1. This accommodation of energy employing a spring-like mechanism inherent to the walls 26 of at least one of the pocket plies assists in enhancing the performance of the baffle or attenuator 10. The selection of an elastomeric material forming the pocket plies 20, 22 will determine in large measure the spring constant, so to speak, associated with the walls 26 along the line of the arrows 34 as well as the capability for the diaphragm 28 to move between positions 30, 32 and the extent to which the positions 30, 32 deviate from a resting (no hydrostatic force(s) applied) position for the diaphragm 28. Where it is desired that the walls provide a spring-like accommodation of acoustic energy it is preferred that the dynamic shear for the elastomer forming the walls be $\leqq 5\times 10^8$ dynes/cm$^2$, the static shear be between about 65 psi (448 kPa) and about 333 psi (2296 kPa) and the static tensile modulus be between about 200 psi (1379 kPa) and about 1000 psi (6895 kPa).

Where it is not desired that the walls provide a spring-like accommodation of acoustic energy, the dynamic shear for the elastomer forming the walls is preferably $\leqq 1\times 10^9$ dynes/cm$^2$, static shear is between about 100 and about 400 psi (690 and 2768 kPa respectively) and the static tensile modulus is between about 300 and about 1200 psi (2068 and 8217 kPa) respectively).

Figure 2:
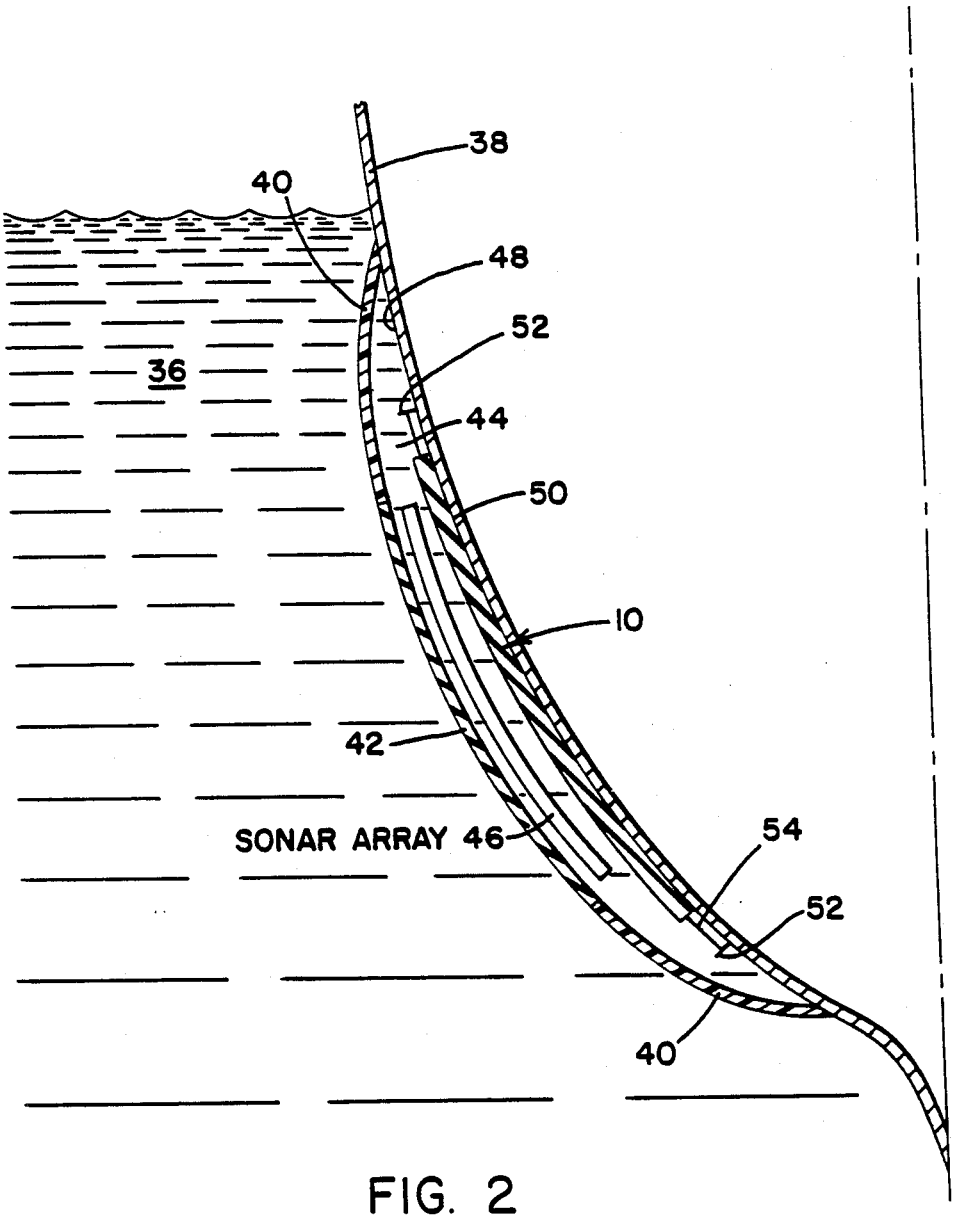
FIG. 2 is a representation of the attachment of a baffle or attenuating reflector made in accordance with the invention within the confines of a fairing.

Referring to FIG. 2, a baffle or attenuator 10 in accordance with the invention is shown embodied upon an object within the marine environment 36. The object in FIG. 2 is a hull 38 of a seagoing surface vessel. A fairing 40 is provided having a window 42 relatively transparent to acoustic signals. The window 42, fairing 40 and hull 38 function to define a chamber 44 protected from the effects of the marine environment such as waves, hydrostatic pressures associated with the motion of the vessel through the marine environment, and collisions of various nature. The chamber 44 is also relatively safe from the deleterious effects of barnacles and other marine biological life.

A sonar array 46 is positioned within the chamber and configured for transmitting and/or receiving acoustic signals through the window 42. The baffle 10 is positioned between the hull 38 and the sonar array 46 and functions to reflect or baffle acoustic frequencies having origin within the hull 38 of the vessel. A surface 48 of the hull and a surface 50 of a pocket ply of the baffle 10 are bonded one to the next. Bonding can be accomplished employing adhesive techniques well-known in marine industry such as by employing a NEOPRENE based cement marketed by The B. F. Goodrich Company under the name of HYDROLOCK® or A-1177B epoxy room temperature curing adhesives, also available from The B. F. Goodrich Company.

A plurality of attachment points 52 are provided upon the surface 48 of the hull 38. These attachment points can be of any suitable or conventional nature configured for attaching the core ply 12 and retaining the core ply 12 and for accepting strains and stresses associated with imposing upon the core ply 12 a tension. The core ply 12 is tensioned between the supports or attachment points 52. The extent of the tension applied is widely variable depending upon the service application for the reflector 10 of the invention. A determination of the correct tension is in significant part a matter of trial and error.

A means 54 is provided for attaching the core ply 12 to the attachment points 52. This means can be of any suitable or conventional nature such as a fabric or a metal cording, wire or cable attached to the core ply employing suitable or conventional means such as grommets, an encircling cable, or other attachment means embeddedly positioned within the core ply. The attachment means 54 is adjusted to place the core ply under a tension. The extent of the tension applied to the core ply in part is determined by the acoustic frequency being baffled or reflected employing the reflector 10, and the temperature at which the reflector 10 is to operate. For a baffle 10 having a diameter of approximately 75 cm, a tension exerting a normal force of about ½ psi (3447 Pa) is typically sufficient.

While the preferred embodiment of the invention has been shown and described in detail it should be apparent that various modifications may be made thereto without departing from the scope of the claims that follows:

What is claimed is:

1. An accoustic reflector comprising:

core ply of an elastomer reinforced fabric, the core ply having a pair of sheet-like surfaces;

a pair of pocket plies each having a surface bonded to one of the pair of core ply surfaces;

means for tensionably attaching the core ply to an object;

a plurality of substantially uniformly configured cell-like cavities embeddedly positioned within each of the pocket plies and separately defined from those within any other pocket ply, the cavities of each such pocket ply being of a size and configuration defining walls having a desired structural configuration separating adjacent cells and the cavities of at least one such pocket ply including a diagram over the cell generally integral with a surface of the pocket ply obverse to that surface of the pocket ply bounded to a core ply surface, the diaphragms having a desired thickness; and the pocket ply being formed of an elastomer having desired static, dynamic, and acoustic properties for the acoustic frequency and at the temperature it is desired the reflector function.

2. The reflector of claim 1, the cells defining frustums.

3. The reflector of claim 2, the cavities being filled with a gaseous fluid under a desired pressure.

4. The reflector of claim 2, one of the pocket plies being attached to a support surface for the reflector.

5. An acoustic, low pressure reflector comprising:

a sheet-like core ply formed from an elastomer selected from a group consisting of natural, synthetic, chlorinated, nitrile, silicone rubbers and mixtures thereof, and fabric reinforcement, and having a pair of sheet-like surfaces;

a pair of pocket plies, the pocket plies each having a surface bonded to a corresponding one of the surfaces of the core ply, the pocket plies each thereby having one surface opposing and bonded to a surface of the sheet-like core ply and an obverse surface;

a plurality of frustum-like cavities within each pocket ply distinct from those within any other pocket ply, said cavities defined by walls and the obverse surface of the respective pocket ply, the walls and the obverse surface each having a thickness sufficient to assure against collapse of the cavities at hydrostatic pressures associated with intended use of the reflector;

the pocket ply being formed from an elastomer selected from the group consisting of: natural, synthetic, chlorinated, nitrile, silicone rubbers and mixtures thereof, and having desired dynamic acoustic properties for the sonic frequency and at the temperature it is desired that the reflector function; and tensioning means configured for attaching the core ply in tension to attachment points associated with a support surface for the reflector.

6. The reflector of claim 5, the cavities being filled with a gaseous fluid under a desired pressure.

7. The reflector of claim 5, the frustum cavities being open to the core ply.

8. The reflector of claim 6, the obverse surface of one of the pocket plies being attached to the support surface.

9. In combination:

a fairing for use on an object adapted for marine operation and wherein a particular hydrostatic pressure environment obtains, the fairing having a window to the marine environment configured for the passage of acoustic waveforms therethrough;

a surface portion of the object to which the fairing is attached defining a support surface and defining a chamber closed to the marine environment between the fairing and the support surface;

an acoustic array positioned within the chamber and configured and arranged for at least one of transmission and reception of acoustic waveforms through the window; and a low pressure acoustic attenuator having:

a sheet-like core ply formed from an elastomeric rubber selected from a group consisting of natural, synthetic, chlorinated, nitrile, silicone rubbers and mixtures thereof, and fabric, the core ply having a pair of sheet-like surfaces;

a pair of pocket plies with one pocket ply having a surface bonded to one of the pair of sheet-like surfaces associated with the core ply and the other pocket ply having a surface bonded to the other sheet-like surface associated with the core ply, the pocket plies each having one surface opposing and bonded to a core ply surface and a obverse surface;

each pocket ply fully containing within itself a plurality of regularly spaced frustum-like cavities defined by walls and the obverse surface of the respective pocket ply, the walls and the obverse surface portion each having a desired thickness sufficient to assure against collapse of the cavities at hydrostatic pressures associated with intended use of the reflector;

the pocket ply being formed from an elastomer selected from the group consisting of; natural, synthetic, chlorinated, nitrile, silicone rubbers and mixtures thereof, and having desired dynamic, static and acoustic properties for the sonic frequency and at the temperature it is desired that the reflector function;

a plurality of attachment points associated with the support surface; and tensioning means configured for attaching the core ply to the attachment points whereby the core ply is tensioned.

10. The combination of claim 9, the cavities being filled with a gaseous fluid under a desired pressure.

11. The combination of claim 9, the frustum cavities being open to the core ply.

12. The combination of claim 10 wherein the obverse surface of one of the pocket plies is attached to the support surface.

13. The combination of claim 11 wherein the obverse surface of one of the pocket plies is attached to the support surface.

14. The combination of claim 9, the support surface being a portion of a marine vessel.

15. The combination of claim 14, the vessel being configured for surface operation only.

16. The combination of claim 12, the support surface being a portion of a marine vessel.

17. The combination of claim 16, the vessel being configured for surface operation only.

18. The combination of claim 13, the support surface being a portion of a marine vessel.

19. The combination of claim 18, the vessel being configured for surface operation only.

20. The reflector of claim 5, the cavities of at least one of said pair of pocket plies being in the shape of a truncated rectilinear solid.

* * * * *

UNITED STATES PATENT AND TRADEMARK OFFICE

CERTIFICATE OF CORRECTION

PATENT NO. : 4,821,243

DATED : April 11, 1989

INVENTOR(S) : Samuel J. Caprette, Jr.

It is certified that error appears in the above-identified patent and that said Letters Patent is hereby corrected as shown below:

Column 7, line 53 - delete "bounded", insert --bonded--

Signed and Sealed this

Twelfth Day of June, 1990

*Attest:*

HARRY F. MANBECK, JR.

*Attesting Officer*

*Commissioner of Patents and Trademarks*